US005553336A

United States Patent [19]

Mariol

[11] Patent Number: 5,553,336

[45] Date of Patent: Sep. 10, 1996

[54] PLAYYARD AND BASSINET COMBINATION

[75] Inventor: John V. Mariol, Cincinnati, Ohio

[73] Assignee: Lisco, Inc., Tampa, Fla.

[21] Appl. No.: 334,841

[22] Filed: Nov. 4, 1994

[51] Int. Cl.[6] ..... A47D 9/00

[52] U.S. Cl. ..... 5/93.1; 5/93.2; 5/95

[58] Field of Search ..... 5/93.1, 93.2, 95, 5/97, 98.1, 98.3; 403/326

[56] References Cited

U.S. PATENT DOCUMENTS

| | | | |
|---|---|---|---|
| 2,569,555 | 10/1951 | Chanslor et al. | 5/95 |
| 3,165,760 | 5/1961 | Abajian | 5/98.1 |
| 4,811,437 | 3/1989 | Dillnear et al. | 5/93.1 |
| 5,077,846 | 1/1992 | Wheeler, III et al. | 5/93.2 |
| 5,163,190 | 11/1992 | Hwang | 5/93.2 |
| 5,172,435 | 12/1992 | Griffin et al. | 5/95 |
| 5,349,709 | 9/1994 | Chang | 5/93.1 |

*Primary Examiner*—Steven N. Meyers
*Assistant Examiner*—Fredrick Conley

[57] ABSTRACT

A bassinet and playyard combination comprising a playyard and a bassinet, the playyard having a lower frame member and an upper frame member defining an opening therebetween. Vertically extending rails between the upper and lower frame members with corner pieces join the corners of the upper frame member with the upper ends of the vertical rails and with a cylindrical well formed vertically in each corner piece. Further provided is a bassinet. The bassinet has a plurality of vertically extending cylindrical posts with lower ends positionable within the wells and with rails defining a supplemental frame adjacent to the upper ends of the posts. The bassinet includes a fabric liner with a central area positioned within and supported by the supplemental frame with vertical panels extending upwardly and around the rails of the supplemental frame and with a rigid platform associated with the fabric member.

5 Claims, 3 Drawing Sheets

PLAYYARD AND BASSINET COMBINATION

BACKGROUND OF THE INVENTION

1. Field of the Invention

This invention relates to a playyard and bassinet combination and, more particularly, to a conventional bassinet having modified upper corner pieces adapted to receive the lower legs of a bassinet whereby a unitary child care product may function both as a bassinet when coupled with the playyard as well as a playyard when the bassinet is removed.

2. Description of the Background Art

Presently, there are a large number of child care products and juvenile furniture products available for use by children and infants. Two such products are playyards in which children may play or sleep within a safe confined space and bassinets wherein a child may be supported at a relatively elevated location for being dressed, changed or otherwise supported for the convenience of the mother or other care provider. Traditionally, playyards and bassinets have been separate items of juvenile furniture. As occurs, however, in all technologies, efforts are being expended to improve all such items of child care products and juvenile furniture products and to construct them in various configurations for use in various combinations so as to make them more convenient for the care provider as well as for the safety of the child or infant.

As evidenced by a large number of prior art patents, efforts are continuing to improve playyards and bassinets and combinations thereof. Consider for example, U.S. Pat. No. 4,967,432 to Kujawski et al which discloses a baby playpen-bassinet combination; U.S. Pat. No. 5,163,191 to Chan which discloses a replaceable two-level crib drape; and U.S. Pat. No. 5,339,470 to Shamie which discloses a combination foldable playpen and dressing/changing table. Consider also U.S. Pat. No. 4,985,948 to the inventor of the present invention which discloses a playyard essentially the same as that disclosed and utilized herein and the subject matter of which is incorporated by reference into the present application.

As will become evident, nothing in the prior art provides the benefits and advantages attendant with the present invention.

Accordingly, it is an object of this invention to provide an improvement which overcomes the inadequacies of the prior art devices and provides an improvement which is a significant contribution to the advancement of the art.

Another object of the present invention is to provide a playyard and bassinet in systems configuration to allow their use together or the playyard separately.

Another object of the present invention is to increase the convenience to the care provider of infants and children.

Another object of the present invention is to promote the safety of babies and children through improved juvenile furniture.

Another object of the present invention is to reduce the cost of child care products and juvenile furniture.

Another object of this invention is to provide a bassinet and playyard combination comprising a playyard and a bassinet, the playyard having a lower frame member and an upper frame member defining an opening therebetween. Vertically extending rails between the upper and lower frame members with corner pieces join the corners of the upper frame member with the upper ends of the vertical rails and with a cylindrical well formed vertically in each corner piece. Further provided is a bassinet. The bassinet has a plurality of vertically extending cylindrical posts with lower ends positionable within the wells and with rails defining a supplemental frame adjacent to the upper ends of the posts. The bassinet includes a fabric liner with a central area positioned within and supported by the supplemental frame with vertical panels extending upwardly and around the rails of the supplemental frame and with a rigid platform associated with the fabric member.

The foregoing has outlined some of the pertinent objects of the invention. These objects should be construed to merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention and the detailed description of the preferred embodiment in addition to the scope of the invention defined by the claims taken in conjunction with the accompanying drawings.

SUMMARY OF THE INVENTION

For the purpose of summarizing this invention, this invention comprises a new and improved playyard and bassinet combination comprising a playyard having a horizontally disposed lower frame member in a rectangular configuration and a horizontally disposed upper frame member in a rectangular configuration defining an opening therebetween. Four vertically extending rails couple the upper and lower frame members at their corners with corner pieces joining the corners of the upper frame member with the upper ends of the rails and with a vertically extending cylindrical well formed in each of the brackets defining a support of a predetermined diameter and depth. Further provided is a bassinet. The bassinet has a pair of inverted U-shaped end members with vertical legs and a cross rail coupling the vertical legs. Each vertical leg has a hollow lower end positionable within a cylindrical well of the playyard. The bassinet also has a pair of parallel horizontally disposed side rails which with the cross rails form a generally rectangular configuration and constitute a supplemental frame member supported by the vertical legs. The bassinet also includes a bracket with a release mechanism removably secured to each vertical leg and also slidably receiving and supporting the side rails between the U-shaped end members. The bassinet also includes a fabric liner with a central rectangular region positioned within the supplemental frame member with vertically extending fabric side panels extending upwardly and around the side rails and the cross rails of the supplemental frame member and with a rigid subfloor centrally positioned within the fabric member. A supplemental platform is selectively positionable in the playyard and bassinet upon the rigid subfloor.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several Figures.

DETAILED DESCRIPTION OF THE PREFERRED EMBODIMENT

Figure 1:
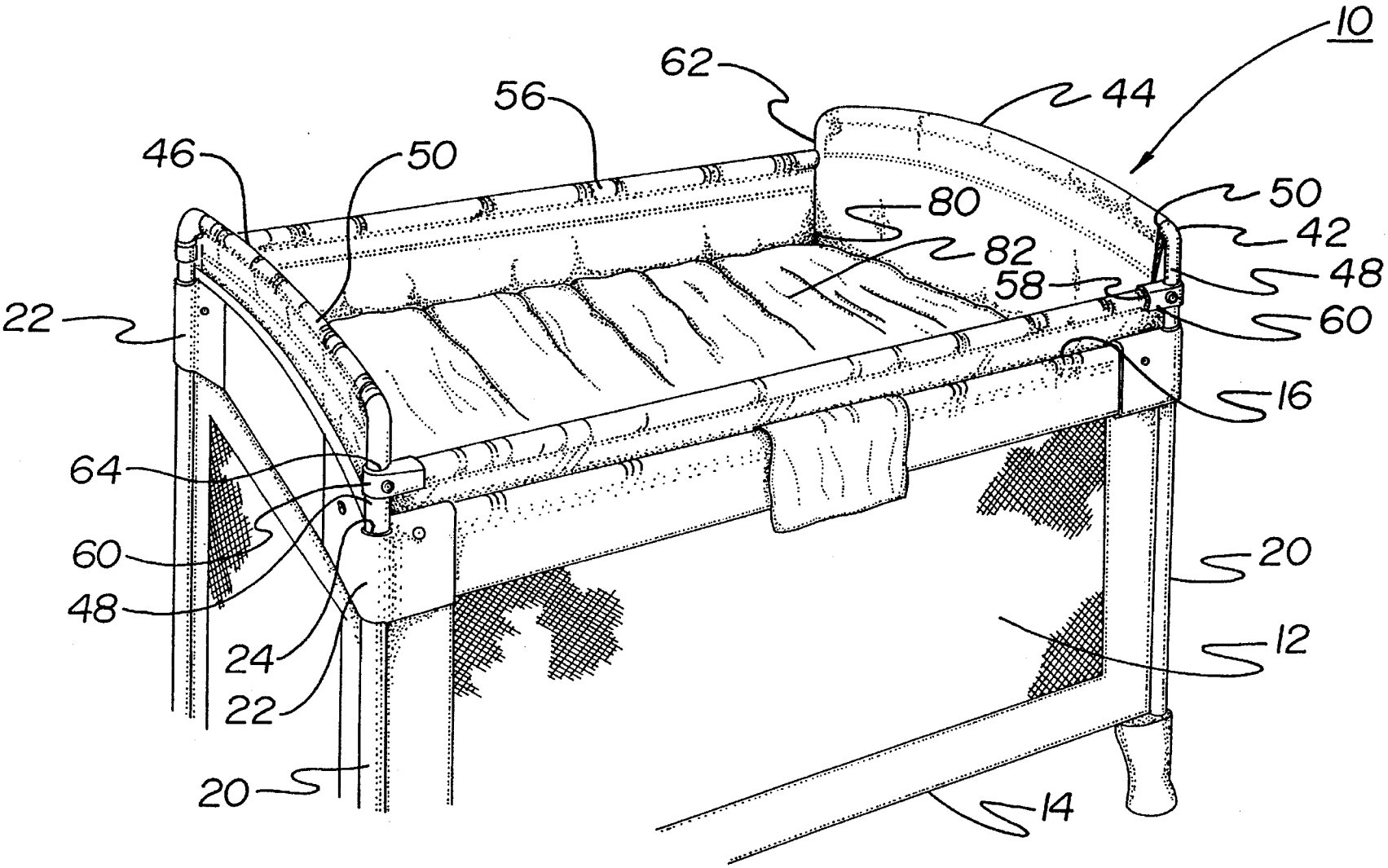
FIG. 1 is a perspective showing of the preferred embodiment of the new and improved playyard and bassinet combination constructed in accordance with the principles of the present invention.
Figure 2:
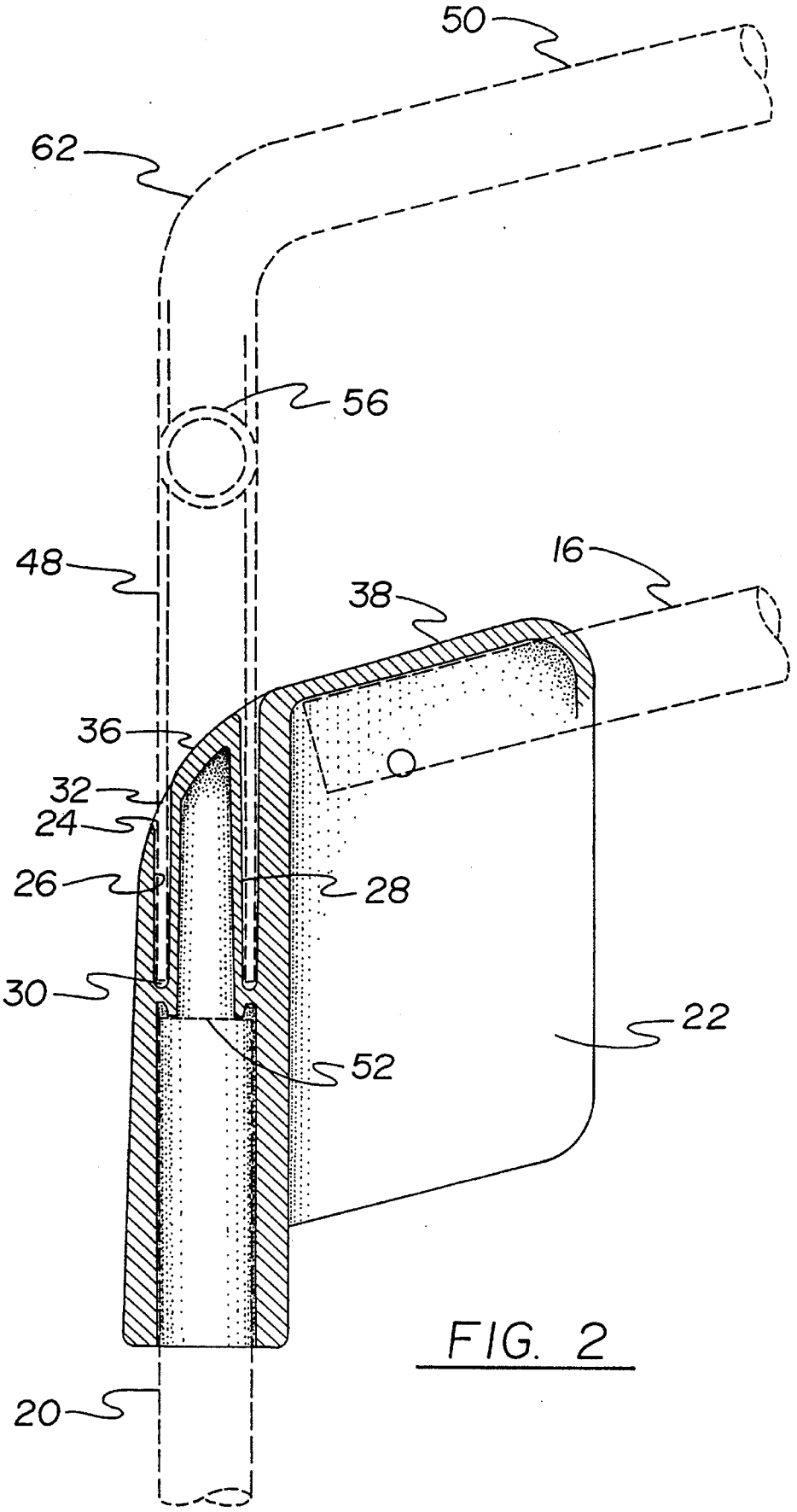
FIG. 2 is a cross-sectional view taken through one of the corner pieces at the upper extent of the playyard and the lower extent of the bassinet.
Figure 3:
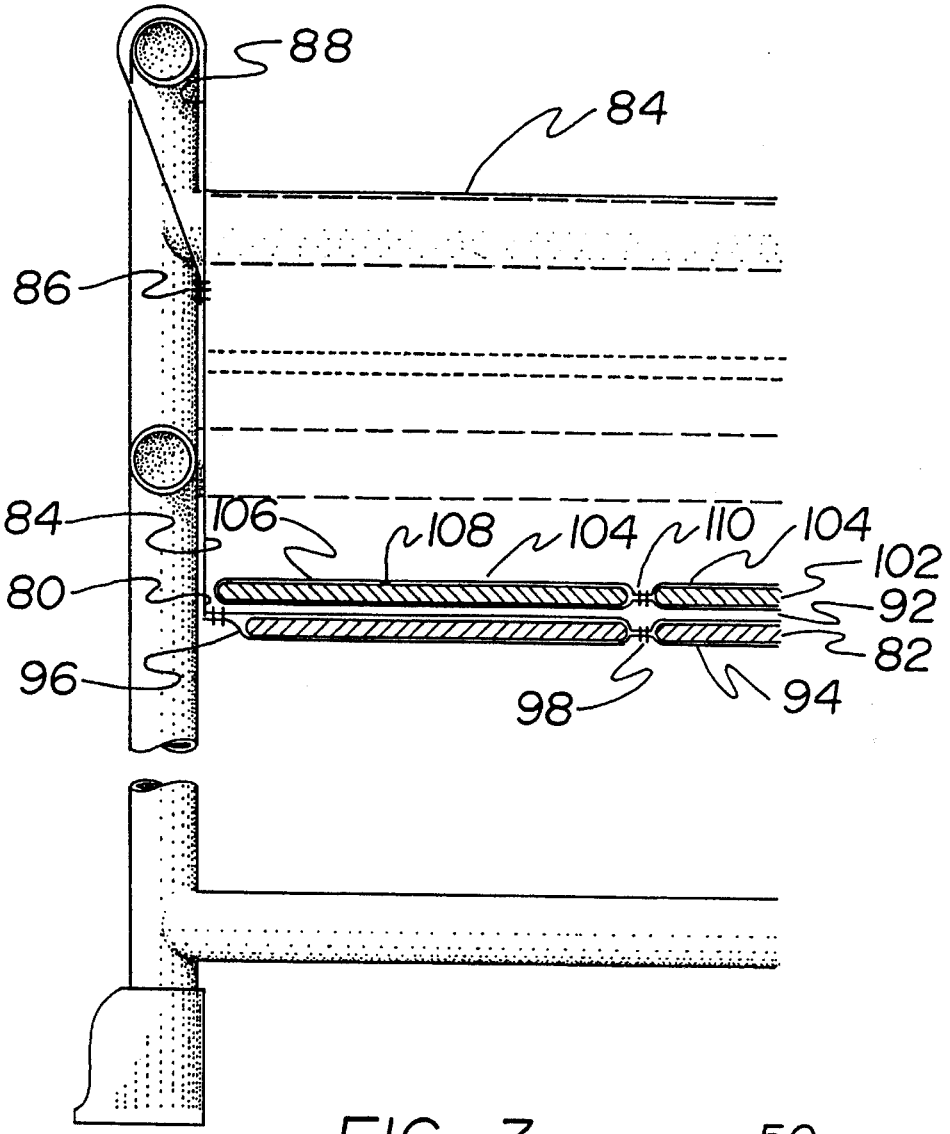
FIG. 3 is a cross-sectional view taken through the bassinet showing the fabric liner and various associated components which form part of the bassinet.
Figure 4:
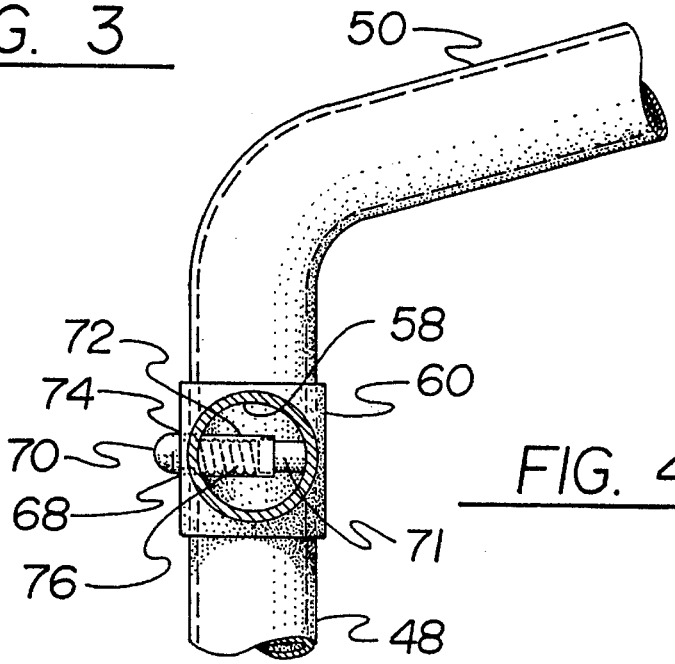
FIG. 4 is a cross-sectional view of the coupling mechanism for releasably coupling the playyard and the bassinet.

With reference now to the drawings, and in particular to FIG. 1 thereof, a new and improved playyard bassinet system embodying the principles and concepts of the present invention and generally designated by the reference numeral 10 will be described.

The present invention, the new and improved playyard and bassinet combination, is comprised of a plurality of components. Such components in their broadest context include a playyard with a lower frame member and an upper frame member and vertical side rails therebetween and with corner pieces having cylindrical wells joining the corners of the upper frame members with the upper ends of the rails, and a bassinet having a supplemental frame member with cylindrical vertical legs removably positionable in the wells and an associated fabric liner with a subfloor, and a supplemental floor selectively positionable on the playyard and bassinet. Such components are individually configured and correlated with respect to each other so as to attain the desired objective.

In another context, the invention may be considered as a new and improved bassinet adapted to be used in association with a playyard modified for the coupling therebetween.

More specifically, the invention has as its central component the playyard 12. Such playyard includes a horizontally disposed lower frame member 14. The lower frame member is formed of side and end rails in an essentially rectangular configuration. The playyard further includes an upper frame member 16 also formed of side and end rails in an essentially rectangular configuration. The upper frame member is essentially the same size as the lower frame member and positioned thereover. An opening is formed between within the periphery of the upper frame member.

Four vertically extending rails 20 couple the upper and lower frame members 14 and 16 at their corners. In addition, molded plastic corner pieces 22 join the corners of the upper frame member with the upper ends of the rails. Formed into each of the corner pieces is a vertically extending cylindrical well 24. Such well defines a cylindrical space of a predetermined diameter and depth and functions as a support for the bassinet as will be described hereinafter. Each cylindrical well 24 is preferably molded integrally with the remainder of its corner piece 22. It is of a cylindrical shape and has an exterior diameter 26 and an interior diameter 28. The bottom of the well defines a bottoming surface 30. Such bottoming surface extends inwardly from the cylindrical vertical recess in the corner piece and has a radially interior end which extends upwardly to form a core 32 for receiving the interior diameter of a vertical rail of the bassinet as will be described hereinafter.

The upper extent of the interior core 32 extends upwardly to a predetermined distance and forms a cap 36 to be essentially coextensive with the upper surface 38 of the corner piece. This will minimize the chance of a child getting a finger stuck or causing other harm to itself or to the care provider.

Next provided as a major component of the system 10 of the present invention is a bassinet 42. The bassinet is formed of a pair of inverted U-shaped end members, a head member 44 and a foot end member 46. Such end members are located above the end rails of the playyard 12. The inverted U-shaped members are each formed with parallel vertical legs 48 and a curved cross rail 50 which couples together the upper ends of the vertical legs. The vertical legs of the inverted U-shaped members have hollow lower ends 52. Each lower end has a predetermined interior diameter and predetermined exterior diameter so as to be slidably received within the well 24 of its associated corner piece 22. As such, the lower end of the vertical legs may be removably positioned within a mating cylindrical well of the playyard.

Also formed as part of the bassinet are parallel horizontally disposed side rails 56. Each of the side rails is removably positioned within a cylindrical recess 58 of a bracket 69 located on each vertical leg of the U-shaped member. The rails of the bassinet thus define a generally rectangular configuration with an open interior and thereby form a supplemental essentially rectangular supplemental frame member 62. Such supplemental frame member is located adjacent to the upper ends 64 of the vertical legs 48.

Each bracket 60 is removably secured to an associated vertical leg 48 through a release mechanism 68. In the preferred embodiment, such release mechanism is a button 70 held within each vertical rail by a support 71 and resiliently biased outwardly by a spring 72. Each button extends outwardly through an aperture 74 in its associated bracket 60 for each corner. Such button also extends through an aligned aperture 76 in its associated vertical leg. An operator may thus push in each button to a location beneath the aperture 74 of the bracket 60 and beneath the aperture 76 in the vertical leg to allow sliding the vertical legs onto the brackets or removing them. The brackets 60 also have a horizontal cylindrical recess 58 for removably receiving and supporting the horizontal rails in a location between the U-shaped end members 44 and 46.

Next provided as part of the bassinet is a fabric liner 80. Such fabric liner includes a central rectangular region 82 positioned within the supplemental frame member. It is located adjacent to the lower extents of the vertical legs. The liner also has vertically extending fabric side panels 84. Such side panels extend upwardly and around the rails in a loose manner wherein they are provided with stitches 86 to form loops 88. In the horizontal rectangular central region 82 of the liner 80, the liner has an upper layer 90 and a lower layer 92 with a space therebetween in which is located a rigid platform 94. The rigid platform is preferably formed of four similarly shaped rigid platform components 96 to allow it to be folded during transportation and storage. A line of stitches 98 through the two layers of fabric holds separate the platform components 96.

The last component of the system 10 is a supplemental rigid platform 102. Such supplemental platform is formed of four rigid components 104 within layers 106 and 108 of a fabric cover. Lines of stitching 110 between the upper and lower layers of the fabric separates the individual panel components. Such supplemental platform may be positioned within the playyard 112 in the conventional manner or, in the alternative, it may be positioned in the bassinet 42 when such is utilized.

In assembling the system 10 of the present invention, the separate inverted U-shaped members 44 and 46 and side rails 56 are sequentially held individually. They are then slid into their respective loops 88 at the upper ends of the fabric liner 80. The brackets 60 are then slid into position on the vertical legs 48 and snapped through the button 70. The ends of the side rails 56, after having received their fabric loops 88, are then slid into the horizontal recesses 58 of the brackets 60. The entire assembled bassinet, including the end members 44 and 46 and side rails 56 with the fabric liner 80 are then slid downwardly with the lower ends of the vertical legs 48 of the U-shaped end members extending into the wells 24 of the corner pieces 22. Thereafter the supplemental platform 102 is placed in position on central region 82 and the fabric liner 80. In disassembling the system 10 of the present invention, the steps as described above are simply reversed.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A new and improved playyard and bassinet combination comprising:

a playyard having a horizontally disposed lower frame member in a rectangular configuration and a horizontally disposed upper frame member in a rectangular configuration defining an opening therebetween, four vertically extending rails coupling the upper and lower frame members at their corners with corner pieces joining the corners of the upper frame member with the upper ends of the rails and with a vertically extending cylindrical well formed in each of the brackets defining a support of a predetermined diameter and depth;

a bassinet having a pair of inverted U-shaped end members with vertical legs and a cross rail coupling the vertical legs, each vertical leg having a hollow lower end positionable within a cylindrical well of the playyard, the bassinet also having a pair of parallel horizontally disposed side rails which with the cross rails form a generally rectangular configuration and constitute a supplemental frame member supported by the vertical legs, the bassinet also including a bracket with a release mechanism removably secured to each vertical leg and also slidably receiving and supporting the side rails between the U-shaped end members, the bassinet also including a fabric liner with a central rectangular region positioned within the supplemental frame member with vertically extending fabric side panels extending upwardly and around the side rails and the cross rails of the supplemental frame member and with a rigid subfloor centrally positioned within the fabric member; and a supplemental platform selectively positionable in the playyard and bassinet upon the rigid subfloor.

2. A system comprising:

a playyard having a lower frame member and an upper frame member defining an opening therebetween, vertically extending rails between the upper and lower frame members with corner pieces joining the corners of the upper frame member with the upper ends of the vertical rails and with a cylindrical well formed vertically in each corner piece; and a bassinet having a plurality of vertically extending cylindrical posts with lower ends positionable within the well and rails defining a horizontally disposed supplemental frame adjacent to the upper ends of the vertical rails, the bassinet including a fabric liner with a central region positioned within and supported by the supplemental frame with vertical supports extending upwardly and coupled to the rails of the supplemental frame, and with a rigid subfloor associated with the fabric member.

3. The system as set forth in claim 2 wherein each cylindrical well is molded into a corner piece and is formed with an exterior diameter and with a cylindrical core to define the cylindrical well with an exterior diameter less than the exterior diameter of the vertical rail and with a cap over the core at the top and with a radially extending annular bottoming surface at the bottom formed radially outwardly from the core.

4. The system as set forth in claim 2 and further including a bracket for each vertical leg of the bassinet and with a vertically disposed aperture adapted to receive a vertical leg of the bassinet and with a horizontally disposed recess for receiving an end of a side rail of the supplemental frame.

5. The system as set forth in claim 4 and further including a release mechanism formed of a horizontally reciprocal button and associated spring positionable through an aperture in the vertical rail and an aligned aperture in the bracket whereby depressing the button will allow relative movement of the bracket and supported side rails along the vertical leg while release of the button will allow the coupling between the side rails and the vertical leg.

* * * * *